United States Patent [19]

Long

[11] Patent Number: 4,959,272

[45] Date of Patent: Sep. 25, 1990

[54] GYPSUM WALLBOARD PAPER HAVING IMITATION MANILA COLORED COATING

[75] Inventor: William J. Long, Chicago, Ill.

[73] Assignee: United States Gypsum Company, Chicago, Ill.

[21] Appl. No.: 932,224

[22] Filed: Nov. 18, 1986

[51] Int. Cl.[5] ..... B32B 13/02

[52] U.S. Cl. ..... 428/537.7; 428/703; 428/903

[58] Field of Search ..... 428/537.7, 903, 703

[56] References Cited

U.S. PATENT DOCUMENTS 2,806,811 9/1957 Von Hazmburg ..... 428/703

3,671,615 6/1972 Price ..... 428/908.3

*Primary Examiner*—Ellis P. Robinson

*Attorney, Agent, or Firm*—John M. Lorenzen; Robert H. Robinson; Samuel Kurlandsky

[57] ABSTRACT

A paper cover sheet particularly designed for use as the face sheet in the manufacture of gypsum wallboard, the face sheet having a base formed of a plurality of filler plies formed of recycled paper comprised of clean hard stocks such as kraft and boxboard cuttings, and being free of topliner plies containing flyleaf furnish, the base having a coating on the face surface thereof comprising a light colored mineral filler and a binder. The coating provides a light color to the face surface generally termed "manila". The elimination of the topliner plies results in a paper of excellent strength and porosity.

6 Claims, No Drawings

GYPSUM WALLBOARD PAPER HAVING IMITATION MANILA COLORED COATING

BACKGROUND OF THE INVENTION

1. Field of the Invention

The present invention is related to paper-making, and more particularly refers to the production of a high strength low cost paper having a light colored face liner surface particularly well adapted for use as cover sheets in the production of gypsum wallboard.

2. Description of the Prior Art

Paper for gypsum board is conventionally made by pulping up waste paper constituents of old corrugated paper, or kraft cuttings and waste news. In cleaning, screening and refining the suspended materials in water suspension, the processed paper stock is diluted still further with water and then formed by draining the plies of paper on several continuously moving wire cylinders, where the separate plies are joined together by a carrying felt. The weak paper web is then dewatered in a press section where water is pressed out of the web. The pressed paper is dried in a multi-cylinder drying section with steam added to each cylinder. The dried paper is subjected to a squeezing or calendaring operation for uniformity in thickness and is then finally wound into rolls. The paper is subsequently utilized as paper cover sheets to form gypsum wallboard by depositing a calcined gypsum slurry between two sheets, and permitting the gypsum to set and dry.

The present day cover sheets which are used in the production of gypsum wallboard are of two kinds. The first is used for the paper cover sheets which are used for the back side of the wallboard, and is formed of recycled wastepaper having many contaminants and a dark color. The second type is used on the outer face side of the wallboard. This is the decorated side. It is generally found as a multi-ply sheet with 2 to 7 filler plies comprised of clean waste paper furnishes such as kraft and boxboard cuttings of a hard stock nature and 1 to 2 topliner plies consisting of mainly flyleaf shavings and newspapers of a soft, groundwood quality used to provide a light, manila colored smooth appearance on the face surface of the gypsum wallboard. The flyleaf shavings waste paper grade can be described as baled trim of magazines, catalogs and similar printed and unprinted material. It contains predominantly bleached chemical fibers, but may also contain as much as 10–40 percent of clays and pigments from coating overlays.

As stated above, the 2 to 7 filler plies of the face cover sheets are comprised of clean hard stocks such as kraft and boxboard cuttings. These particular furnish constituents are of such a nature that they are inherently strong. Equally important, they can develop further strength on refining. As a result of these favorable pulp qualities, the final total sheet strength of the gypsum board face cover sheets is predominantly dependent on the furnish make-up of the cover sheet's 2 to 7 filler plies. The refined hard stock fibers comprising the filler plies are further identified with easy dewatering, fast drainage, and easy drying. This translates into faster paper production and less energy requirements for drying. In addition, the resultant sheet filler structures are very open or highly pourous. This further translates into easier gypsum board drying and faster board line speeds.

In sharp contrast, the furnish components of the 1 to 2 topliner plies which are used to provide a suitable light colored, smooth face appearance are generally formed of 70–80% flyleaf furnish, old magazine and trim, and 20% waste news. These topliner plies behave in quite a different fashion. The soft ground wood waste newspaper constituent is inherently weak in strength qualities and has minimal potential for increased strength development. In fact, it has been found that the liner plies of flyleaf furnish and groundwood newsprint provide little if any strength to the finished total sheet. The high proportions of inert clays and fillers contained in the flyleaf shavings stock constituent further substract from the integrity of the liner plies. Moreover, the soft stocks and clays contained in the manila liner overlay produce a furnish pulp historically noted for poor dewatering, slow drainage, and difficult drying. This results in slower paper production and increased energy requirement for drying. Briefly summarized, it can readily be seen that the current cellulosic furnish consisting of waste newspapers and flyleaf shavings that typically is used as topliners of the manila gypsum wallboard paper grade contributes to substantial furnish and operational problems. It provides negligible strength to the finished sheet. In addition the pulp slurry dewaters with difficulty, thereby adversely affecting the draining and drying conditions of the total filler/liner sheet. This results in poorer machine operability, lower production rates, and increased energy requirements.

Obviously, one corrective measure to obviate these problem conditions would be to replace the current "waste" stocks with "virgin" stocks. This would allow for predictable liner ply strength and would eliminate the critical clays and fillers associated with the flyleaf overlays. However, the cost of doing so would be prohibitive.

The filler plies conventionally utilized in the manufacture of paper for use in the manufacture of gypsum wallboard comprise various recycled papers. The plies have excellent strength and suitable porosity for rapid evaporation of moisture. However, they generally produce a paper which is quite dark in color and not suitable for use on the face surface of gypsum board which conventionally must have a white or manila color. Consequently, conventionally one or two liner plies are applied on the outer surface of the face paper to give the paper the required light color. The recycled paper conventionally used for the production of filler plies and which are utilized to produce the filler plies of the present invention are mixed paper, boxboard cuttings, corrugated containers, new corrugated cuttings, new double kraft lined corrugating cuttings, new kraft corrugated cuttings, used brown kraft bags, mixed kraft bags, sorted brown kraft, new brown kraft cuttings, new brown kraft bag waste, and new brown kraft envelope cuttings.

Liner plies are conventionally made from news, super news, special news de-ink quality, over-issue news, mixed shavings, groundwood shavings, white newsblanks, flyleaf shavings, manila tabulating cards, computer printout, and coated groundwood sections.

Following are definitions of the various recycled paper pulps listed above, as defined in *Paper Stock Institute of America, Paper Stock Standards and Practices, Circular PS-77.*

Mixed paper consists of a mixture of various qualities of paper not limited as to type of packing or fibre content.

Boxboard cuttings consists of baled new cuttings of paperboard such as are used in the manufacture of folding paper cartons, set-up boxes and similar boxboard products.

Corrugated containers consists of baled corrugated containers having liners of either jute or kraft.

New corrugated cuttings consists of baled corrugated cuttings having two or more liners of either jute or kraft. Non-soluble adhesives, butt rolls, slabbed or hogged medium, and treated medium or liners are not acceptable in this grade.

New double kraft lined corrugated cuttings consists of baled corrugated cuttings having all liners of kraft. Non-soluble adhesives, butt rolls, slabbed or hogged medium, and treated medium or liners are not acceptable in this grade.

New kraft corrugated cuttings consists of baled corrugated cuttings having all liners of kraft. The corrugated medium must be either semichemical or other similar uniform medium, Non-soluble adhesives, butt rolls, slabbed or hogged medium, and treated medium or liners are not acceptable in this grade.

Used brown kraft bags consists of baled brown kraft bags free of objectionable liners or contents.

Mixed kraft bags consists of baled used kraft bags free from twisted or woven stock and other similar objectionable materials.

Sorted brown kraft consists of baled clean sorted brown kraft papers, free from twisted or woven stock, sewed edges and heavy printing.

New brown kraft cuttings consists of baled new unprinted brown kraft cuttings or sheets entirely free from sewed edges, twisted or woven stock.

New brown kraft bag waste consists of new brown kraft cuttings and sheets, including misprint bags. Stitched or sewed papers are not acceptable in this grade, and New brown kraft envelope cuttings consists of baled new unprinted brown kraft envelope cuttings or sheets.

The definitions of materials utilized for liner plies taken from the same publication are as follows:

News consists of baled newspapers containing less than 5% of other papers.

Super news consists of baled sorted fresh newspapers, not sunburned, free from papers other than news, containing not more than the normal percentage of rotogravure and colored sections.

Special news de-ink quality consists of baled sorted fresh dry newspapers, not sunburned, free from magazines, white blank, pressroom over-issues, and paper other than news, containing not more than the normal percentage of rotogravure and colored sections. This packing must be free from tare.

Over-issue news consists of unused over-run regular newspapers printed on newsprint, baled or securely tied in bundles, containing not more than the normal percentage of rotogravure and colored sections.

Mixed shavings consists of baled trim of magazines, catalogs and similar printed matter, not limited with respect to groundwood or coated stock, and may contain the bleed of cover and insert stock as well as beater-dyed papers and solid color printing.

Groundwood shavings consists of baled trim of magazines, catalogs and similar printed matter free from beater-dyed papers, and may contain not over 5% of solid color printing.

White newsblanks consists of baled unprinted cuttings and sheets of white newsprint paper or other papers of white groundwood quality, free of coated stock.

Flyleaf shavings consists of baled trim of magazines, catalogs and similar printed matter. It may contain the bleed of cover and insert stock to a maximum of 10% of dark colors, and must be made from predominately bleached chemical fibre. Beater-dyed papers may not exceed 2%. Shavings of novel news or newsprint grades may not be included in this packing.

Manila tabulating cards consists of printed manila-colored cards, predominately sulphite or sulphate, which have been manufactured for use in tabulating machines. This grade may contain manila-colored Computer printout consists of white sulphite of sulphate papers in forms manufactured for use in data processing machines. This grade may contain color stripes and/or computer printing, and may contain not more than 5% of groundwood in the packing. All stock must be untreated and uncoated, and Coated groundwood sections consists of new printed, coated groundwood papers in sheets, sections, shavings or guillotined books. This grade shall not include news quality groundwood papers.

SUMMARY OF THE INVENTION

It is accordingly an object of the invention to provide paper for use as face paper cover sheets in the production of gypsum wallboard.

It is another object of the invention to provide paper for use in making gypsum wallboard which requires less energy for drying than conventional paper previously utilized for this purpose.

It is still another object to provide a paper of the type described which has sufficiently high tensile strength for use in gypsum wallboard.

It is a further object of the invention to eliminate the critical cellulosic outer liner of recycled, waste stock from the paper web during the refining, draining, drying and formative stages.

It is still another object of the invention to provide gypsum wallboard face paper having a multi-ply composition in which all of the plies are comprised of clean waste paper filler plies of a hard stock nature such as kraft and boxboard cuttings, and free of topliner plies of soft woods.

It is still a further object to provide a manila grade paper sheet having comparable strength characteristics, improved drainage, and improved drying conditions.

It is another object of the invention to provide a gypsum wallboard face paper that is receptive to excellent joint compound adhesion and excellent paint adhesion.

It is still further an object of the invention to provide gypsum wallboard paper cover sheets providing good bonding to the gypsum core, and which affords economy in the board manufacturing process.

Other objects and advantages of the invention will become apparent upon reference to the description below.

According to the invention a paper eminently suitable as outer face sheets for use in fabricating gypsum wallboard is provided utilizing substantially conventional paper processes and having a paper composition comprised solely of two to seven filler plies formed from clean waste paper furnishes such as kraft corrugated board cuttings, kraft bags/wrapping and waste news, primarily of a hard stock nature, while eliminating conventional topliner plies consisting of flyleaf shavings and newspapers of a soft, ground wood quality. In order to provide the light color such as manila and hiding power of the presently utilized manila liner overlay, a coating is applied to the dried paper comprising a white mineral filler or pigment together with a binder and clays and other desired ingredients. The finished paper has high strength by virtue of the kraft and boxboard waste paper cuttings furnish. Additionally, by virtue of the elimination of the upper two topliner plies, improved water drainage and drying on board conversion is obtained. Moreover, the cost of the coating is considerably less than the cost of the conventional outer liner plies. Further, the paper has good color and adhesive properties.

DESCRIPTION OF THE PREFERRED EMBODIMENTS

The examples which follow provide specific embodiments of the procedures for carrying out the present invention, but are not to be regarded as limiting.

EXAMPLE 1

A paper was fabricated for use as face sheets in making gypsum wallboard. In fabricating the paper, a pulp furnish was first prepared from wastepaper comprising 50% corrugated kraft cuttings, 20% kraft bags/wrapping, and 30% waste news. The furnish was mixed with water and beaten to the proper consistency in conventional manner. A paper base was thus formed comprised of five plies and then dried. The dry paper was coated with Michelman's coating designated as Color Coat White 5A. Prior to coating the coating material was diluted with water to a consistency of 25% solids. The coating was applied at the starch box on the calendar stack at the dry end of the paper machine. The coating solids pickedup was about 1.25 lbs. per 1000 sq. ft. of paper, on a dry solid basis.

Michaelman's Color Coat White 5A is a proprietary coating composition prepared and marketed by the Michaelman Company. 9089 Shell Road, Cincinnati, Ohio 45236. The ingredients are believed to comprise clay, titanium dioxide, and polyvinyl acetate.

EXAMPLE 2

A paper base was formed having 5-plies and utilizing the same pulp furnish and the same process as that of Example 1. After drying, the paper was coated in the same manner with a coating composition set out in Table I, below:

TABLE I

| | Pounds |
|---|---|
| Water | 384.20 |
| Hydroxypropyl methycellulose | 2.80 |
| Dowicil 75 | 1.00 |
| Troysan | 0.50 |
| Tamol | 7.00 |
| AMP-95 | 6.00 |
| Drewplus L-75 | 4.00 |
| Ethylene glycol | 4.50 |
| Hexylene glycol | 4.50 |
| $TiO_2$ | 250.00 |
| Clay | 338.00 |
| Mica | 22.00 |
| Aluminum silicate | 180.00 |
| Polyvinyl acetate | 225.00 |

In the formulation of Table I above:

Dowicil 75 is a proprietary preservative marketed by Dow Chemical Company.

Troysan is an proprietary anti-mold preservative marketed by the Troy Chemical Corporation, and is 3-iodo-2-propynyl butyl carbamate.

Tamol 731 is an anionic proprietary wetting agent marketed by Rohm and Haas Company, and is the salt of a polymeric carboxylic acid.

AMP-95 is a proprietary dispersant marketed by International Minerals and Chemical Corporation having the formula 2-amino-2-methyl-1-propanol.

Drewplus L-75 is a proprietary defoamer marketed by Drew Chemical Corporation.

The materials of the formulation of Table I may be substituted for by other materials available in the market having identical or similar functionality.

EXAMPLE 3

Samples of the paper produced in both Examples 1 and 2 were utilized as face sheets in the production of gypsum wallboard. In conventional manner, an aqueous gypsum slurry was deposited between a back sheet of conventional paper and a face sheet as produced in Examples 1 and 2, with the coated surface of the paper on the outside of the slurry. The face sheets of both samples showed excellent color. Both samples were tested for receptivity and adhesion to joint compound and paints. Both samples showed excellent properties in regard to these tests.

The paper of the present invention has a number of advantages. First, it provides an excellent face surface having good color. The elimination of the conventional face plies results in a substantial cost savings, since the conventional face plies must generally be produced from an expensive high quality furnish in order to achieve the proper surface color. The conventional face plies do not contribute to the strength of the paper since the pulp utilized is substantially weak; therefore the paper base coated with a coating according to the invention is of substantially the same strength as one having the additional face plies of special furnish. Additionally, in the manufacture of conventional face paper, the presence of the outer face plies impede the transmission of moisture, and therefore inhibit drying of the paper and require additional heat energy for the drying process. By the use of only filler plies without the additional liner plies, drying of the paper is greatly facilitated and there results a considerable cost savings.

It is to be understood that the invention is not to be limited to the exact details of operation or materials described, as obvious modifications and equivalents will be apparent to one skilled in the art.

Invention is claimed as follows:

1. A paper cover sheet particularly designed for use as the face sheet in manufacturing gypsum wallboard, comprising a base formed of a Plurality of filler plies formed from recycled paper pulp, said cover sheet being free of topliner plies and having a coating on the face surface thereof comprising a light colored mineral filler and a binder, thereby providing a finished face surface of light color.

2. A paper cover sheet according to claim 1, wherein said base is comprised of only filler plies of clean hard stocks including kraft and boxboard cuttings.

3. A paper cover sheet according to claim 1, wherein said coating filler is titanium dioxide, and said binder is polyvinyl acetate.

4. Gypsum wallboard comprising a core of calcium sulphate dihydrate, a cover sheet on the back surface of said core comprised of recycled wastepaper, and a face cover sheet on the face surface of said wallboard comprising a base of a plurality of filler plies formed from recycled paper pulp and being free of topliner plies, said face cover sheet having a coating on the face surface thereof comprising a light colored mineral filler and binder, thereby providing a finished face surface light in color.

5. Gypsum wallboard according to claim 4, wherein said base is comprised of only filler plies of clean hard stocks including kraft and boxboard cuttings.

6. Gypsum wallboard according to claim 3, wherein said coating filler is titanium dioxide and said binder is polyvinyl acetate.

* * * * *